US005302577A

United States Patent [19]

Sens et al.

[11] Patent Number: 5,302,577

[45] Date of Patent: Apr. 12, 1994

[54] TRANSFER OF ANTHRAQUINONE DYES

[75] Inventors: Ruediger Sens; Thomas Werner, both of Mannheim; Karl-Heinz Etzbach, Frankenthal, all of Fed. Rep. of Germany

[73] Assignee: BASF Aktiengesellschaft, Ludwigshafen, Fed. Rep. of Germany

[21] Appl. No.: 38,867

[22] Filed: Mar. 29, 1993

[30] Foreign Application Priority Data

Apr. 30, 1992 [DE] Fed. Rep. of Germany ..... 4214175

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 3,617,173 | 11/1971 | Hildreth et al. . | |
| 4,940,692 | 7/1990 | Bach et al. | 503/227 |
| 5,132,438 | 7/1992 | Bach et al. | 552/295 |
| 5,155,089 | 10/1992 | Etzbach et al. | 503/227 |
| 5,208,210 | 5/1993 | Sens et al. | 503/227 |

FOREIGN PATENT DOCUMENTS

| | | |
|---|---|---|
| 3-158294 | 7/1991 | Japan . |
| 1456957 | 12/1976 | United Kingdom . |

OTHER PUBLICATIONS

Houben-Weyl, vol. 7/3c, pp. 251-252.

Mitsui Toatsu Chem Inc, Derwent-Abstracts, JO-12-21-287-A, Mar. 1, 1988. "Anthraquinone series dye--suitable for sublimation transfer recording".

Mitsubishi Chem Ind KK, Derwent-Abstracts, J6 0053-563-A, Sep. 2, 1983. "New anthraquinone dye for heat-sensitive transfer recording-sublimes under working conditions of recording head".

Mitsubishi Chem Ind KK, Derwent-Abstracts, J5 9227-948-A, Jun. 9, 1983. "New anthraquinone cpds.-used for heat-sensitive sublimation type transfer recording".

*Primary Examiner*—B. Hamilton Hess

*Attorney, Agent, or Firm*—Oblon, Spivak, McClelland, Maier & Neustadt

[57] ABSTRACT

Anthraquionone dyes are transferred by diffusion or sublimation from a carrier to a plastic-coated substrate with the aid of an energy source by using a carrier on which one or more anthraquinone dyes I

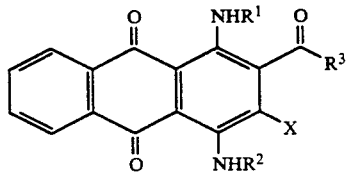

I where

X is hydrogen or cyano, $R^1$, $R^2$ and $R^3$ independently of one another are each hydrogen, alkyl, alkanoyloxyalkyl, alkoxycarbonyloxyalkyl or alkoxycarbonylalkyl, each of which may be of up to 20 carbon atoms and may be substituted by halogen, hydroxyl or cyano, phenyl or benzyl, each of which may be substituted by $C_1$-$C_{15}$-alkyl or $C_1$-$C_{15}$-alkoxy and a radical of the formula II $$[-W-O]_n-R^4 \qquad \text{II}$$

where

W is identical or different $C_2$-$C_6$-alkylene radicals, n is from 1 to 6 and $R^4$ is $C_1$-$C_4$-alkyl or unsubstituted or $C_1$-$C_4$-alkyl-substituted or $C_1$-$C_4$-alkoxy-substituted phenyl, are present.

4 Claims, No Drawings

TRANSFER OF ANTHRAQUINONE DYES

The present invention relates to a novel process for transferring anthraquinone dyes by diffusion or sublimation from a carrier to a plastic-coated substrate with the aid of an energy source.

In the thermal transfer printing process, a transfer sheet which contains a thermally transferable dye in one or more binders, with or without suitable assistants, on a carrier is heated from the back by means of an energy source, for example a thermal printing head or a laser, by short heat pulses lasting fractions of a second, with the result that a dye migrates from the transfer sheet and diffuses into the surface coating of an absorbing medium, as a rule into the plastic layer of the coated paper. The essential advantage of this process is that the amount of dye to be transferred (and hence the color degradation) can be readily controlled by adjusting the energy to be released by the energy source.

In general, the color recording is carried out using the subtractive primary colors yellow, magenta and cyan (and, if required, black).

In order to permit optimum color recording, dyes must have the following properties: easy thermal transferability; little tendency to migrate within or out of the surface coating of the absorbing medium at room temperature; high thermal and photochemical stability and resistance to moisture and chemicals; no tendency to crystallize during storage of the transfer sheet; a suitable shade for the subtractive color mix; a high molar absorption coefficient.

Experience has shown that these requirements are very difficult to meet simultaneously. Most of the known blue dyes used for thermal transfer printing therefore do not meet the stated requirements. This also applies to the 1,4-diaminoanthraquinones which are disclosed in EP-A-337 200 and JP-A-227 948/1984, 53 563/1985 and 221 287/1989, are recommended as blue dyes for thermal transfer printing and are similar to the compounds I used in the novel process but carry an alkoxycarbonyl radical in the 2-position.

It is an object of the present invention to provide suitable blue dyes for thermal transfer printing processes, which dyes come closer to having the required property profile than the dyes known to date.

We have found that this object is achieved by a novel process for transferring anthraquinone dyes by diffusion or sublimation from a carrier to a plastic-coated substrate with the aid of an energy source, which comprises using a carrier on which one or more anthraquinone dyes of the general formula I

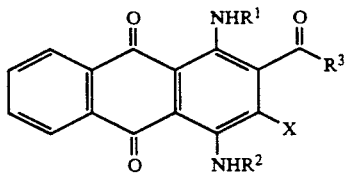

I where

X is hydrogen or cyano, $R^1$, $R^2$ and $R^3$ independently of one another are each hydrogen, alkyl, alkanoyloxyalkyl, alkoxycarbonyloxyalkyl or alkoxycarbonylalkyl, each of which may be of up to 20 carbon atoms and may be substituted by halogen, hydroxyl or cyano, phenyl or benzyl, each of which may be substituted by $C_1$–$C_{15}$-alkyl or $C_1$–$C_{15}$-alkoxy or a radical of the general formula II $$[-W-O]_n-R^4 \qquad \text{II}$$

where the radicals W are identical or different $C_2$–$C_6$-alkylene radicals, n is from 1 to 6 and $R^4$ is $C_1$–$C_4$-alkyl or unsubstituted or $C_1$–$C_4$-alkyl-substituted or $C_1$–$C_4$-alkoxy-substituted phenyl, are present.

Preferred embodiments of this process are described in the subclaims.

Suitable radicals $R^1$, $R^2$ or $R^3$ are $C_1$–$C_{20}$-alkyl, preferably $C_1$–$C_{12}$-alkyl and, in the case of $R^3$, particularly preferably $C_1$–$C_4$-alkyl. Specific examples are methyl, ethyl, propyl, isopropyl, butyl, isobutyl, sec-butyl, tert-butyl, pentyl, isopentyl, sec-pentyl, tert-pentyl, hexyl, 2-methylpentyl, heptyl, octyl, 2-ethylhexyl, nonyl, decyl, undecyl, dodecyl, tridecyl, tetradecyl, pentadecyl, hexadecyl, heptadecyl, octadecyl, nonadecyl, eicosyl and branched radicals of this type.

The alkyl groups can also be substituted by halogen, hydroxyl or cyano; examples here are:

$-(CH_2)_5-Cl$, $-CH(C_4H_9)-(CH_2)_3-Cl$ and $-(CH_2)_4-CF_3$;

$-(CH_2)_2-CH(CH_3)-OH$, $-(CH_2)_2-CH(C_4H_9)-OH$ and $-(CH(C_2H_5)-(CH_2)_9-OH$;

$-(CH_2)_2-CN$, $-(CH_2)_3-CN$, $-CH_2-CH(CH_3)-CH(C_2H_5)-CN$, $-(CH_2)_6-CH(C_2H_5)-CN$ and $-(CH_2)_3-CH(CH_3)-(CH_2)_2-CH(CH_3)-CN$.

Examples of suitable alkanoyloxyalkyl, alkoxycarbonyloxyalkyl and alkoxycarbonylalkyl groups $R^1$, $R^2$ or $R^3$ are:

$-(CH_2)_2-O-CO-CH_3$, $-(CH_2)_3-O-CO-(CH_2)_7-CH_3$, $-(CH_2)_2-O-CO-(CH_2)_3-Ph-2-O-CH_3$, $-CH(CH_2-Ph-3-CH_3)-O-CO-C_4H_9$ and $-(CH_2)_4-O-CO-(CH_2)_4-CH(C_2H_5)-OH$;

$-(CH_2)_2-O-CO-O-CH_3$, $-(CH_2)_3-O-CO-O-(CH_2)_7-CH_3$, $-CH(C_2H_5)-CH_2-O-CO-O-C_4H_9$, $-(CH_2)_4-O-CO-O-(CH_2)_2-CH(CH_3)-O-Ph-3-CH_3$ and $-(CH_2)_5-O-CO-O-(CH_2)_5-CN$;

$-(CH_2)_2-CO-O-CH_3$, $-(CH_2)_3-CO-O-C_4H_9$, $-(CH_2)_3-CH(CH_3)-CH_2-CO-O-C_4H_9$, $-(CH_2)_3-CH(C_4H_9)-CH_2-CO-O-C_2H_5$, $-(CH_2)_2-CO-O-(CH_2)_5-Ph$, $-(CH_2)_4-CO-O-(CH_2)_4-Ph-4-C_4H_9$, $-(CH_2)_3-CO-O-(CH_2)_4-O-Ph-3-O-CH_3$, $-(CH_2)_2-CH(CH_2OH)-(CH_2)_2-CO-O-C_2H_5$, $-CH(C_2H_5)-CH_2-CO-O-(CH_2)_4-OH$ and $-(CH_2)_3-CO-O-(CH_2)_6-CN$.

If $R^1$, $R^2$ or $R^3$ is a group of the formula II, suitable alkylene groups W are, for example, 1,2-, 1,3-, 1,4- or 2,3-butylene, pentamethylene, hexamethylene, 2-methylpentamethylene, in particular 1,2- and 1,3-propylene and especially ethylene, and $R^4$ is preferably methyl, ethyl, propyl, isopropyl, butyl or phenyl which may be substituted, for example, by methyl, ethyl, propyl, butyl, methoxy, ethoxy, propoxy or butoxy but is preferably unsubstituted. Examples of particularly preferred groups II (where Ph is phenyl) are:

—$(CH_2)_2$—O—$CH_3$, —$(CH_2)_2$—O—$C_2H_5$, —$(CH_2)_2$—O—$C_3H_7$, —$(CH_2)_2$—O—$C_4H_9$, —$(CH_2)_2$—O—Ph, —$(CH_2)_2$—O—$CH_2$—Ph, —[$(CH_2)_2$—O]$_2$—$CH_3$, —[$(CH_2)_2$—O]$_2$—Ph, —[$(CH_2)_2$—O]$_2$—Ph—4—O—$C_4H_9$, —[$(CH_2)_2$—O]$_3$—$C_4H_9$, —[$(CH_2)_2$—O]$_3$—Ph, —[$(CH_2)_2$—O]$_3$—Ph—3—$C_4H_9$, —[$(CH_2)_2$—O]$_4$—$CH_3$ and —$(CH_2)_3$—O—$(CH_2)_2$—O—Ph.

Examples of further preferred groups II are:

—$(CH_2)_3$—$CH_3$, —$(CH_2)_3$—O—$C_2H_5$, —$(CH_2)_3$—O—$C_3H_7$,

—$(CH_2)_3$—O—$CH(CH_3)_2$, —$(CH_2)_3$—O—$C_4H_9$, —$(CH_2)_3$—O—Ph,

—$CH_2$—$CH(CH_3)$—O—$CH_3$, —$CH_2$—$CH(CH_3)$—O—$C_2H_5$, —$CH_2$—$CH(CH_3)$—O—$C_3H_7$,

—$CH_2$—$CH(CH_3)$—O—$C_4H_9$, —$CH_2$—$CH(CH_3)$—O—Ph,

—$(CH_2)_4$—O—$CH_3$, —$(CH_2)_4$—O—$C_2H_5$, —$(CH_2)_4$—O—$C_4H_9$, —$(CH_2)_4$—O—Ph,

—$(CH_2)_4$—O—$CH_2$—Ph—2—O—$C_2H_5$, —$(CH_2)_4$—O—$C_6H_{10}$—2—$C_2H_5$,

—[$(CH_2)_4$—O]$_2$—$C_2H_5$, —[$(CH_2)_2$—$CH(CH_3)$—O]$_2$—$C_2H_5$,

—$(CH_2)_5$—O—$CH_3$, —$(CH_2)_5$—O—$C_2H_5$, —$(CH_2)_5$—O—$C_3H_7$, —$(CH_2)_5$—O—Ph,

—$(CH_2)_2$—$CH(C_2H_5)$—O—$CH_2$—Ph—3—O—$C_4H_9$, —$(CH_2)_2$—$CH(C_2H_5)$—O—$CH_2$—Ph,

—$(CH_2)_6$—O—$C_4H_9$, —$(CH_2)_6$—O—Ph—4—O—$C_4H_9$ and

—$(CH_2)_3$—$CH(CH_3)$—$CH_2$—O—$C_4H_9$.

Other suitable radicals $R^1$, $R^2$ or $R^3$ are benzyl and especially phenyl, each of which may carry up to three $C_1$-$C_{15}$-alkyl or $C_1$-$C_{15}$-alkoxy radicals, preferably $C_1$-$C_4$-alkyl or $C_1$-$C_4$-alkoxy radicals, but are preferably disubstituted or monosubstituted or unsubstituted. Examples of suitable radicals are:

—Ph, —Ph—2—$CH_3$, —Ph—3—$CH_3$, —Ph—4—$CH_3$, —Ph—4—$(CH_2)_{10}$—$CH_3$,

—Ph—3—$(CH_2)_5$—$CH(CH_3)$—$CH_3$,

—Ph—4—$(CH_2)_5$—$CH(C_2H_5)$—$CH_3$,

—Ph—4—O—$C_4H_9$ and —Ph(2—$CH_3$,)—5—$CH_3$;

—$CH_2$—Ph, —$CH_2$—Ph—2—$CH_3$, —$CH_2$—Ph—3—$CH_3$, —$CH_2$—Ph—4—$CH_3$,

—$CH_2$—Ph—3—$C_2H_5$, —$CH_2$—Ph—3—O—$CH_3$, —$CH_2$—Ph—4—O—$CH_3$,

—$CH_2$—Ph—O—$C_2H_5$ and —$CH_2$—Ph(2—$CH_3$)—5—$CH_3$.

$R^1$ is particularly preferably hydrogen, $R^2$ is particularly preferably phenyl which may be substituted by $C_1$-$C_4$-alkyl or $C_{1-C4}$-alkoxy, $R^3$ is preferably $C_{1-C4}$-alkyl, in particular methyl, and X is particularly preferably cyano and especially hydrogen.

The anthraquinone dyes I are known per se or can be prepared by known methods. In the case of the anthraquinones I having an acetyl group in the 2-position, for example, 1-amino-2-acetylanthraquinone (Houben-Weyl, Vol. 7/3 c, page 251) is advantageously used as a starting material and can be brominated and then subjected to an Ullmann reaction in a conventional manner with the desired amines.

In comparison with the anthraquinone dyes used in the known manner, the dyes I employed in the novel process generally have improved migration properties in the absorbing medium at room temperature, easier thermal transferability, higher thermal and photochemical stability, easier technical accessibility, better resistance to moisture and chemicals, higher color strength, better solubility or better suitability for the subtractive color mix (higher shade purity, more advantageous form of absorption band, higher transparency in the green spectral range).

For the prepartion of the dye carrier required for the novel process, the dyes, in a suitable organic solvent or in a mixture of solvents, are processed with one or more binders, with or without the addition of assistants to give a printing ink. The latter contains the dye preferably in the form of a molecular disperse solution. The printing ink can be applied to the inert carrier by means of a doctor blade. The dyeing obtained is then dried in the air.

Suitable organic solvents are those in which the solubility of the dyes I at 20° C. is in general greater than 1, preferably greater than 5, % by weight.

Examples are ethanol, propanol, isobutanol, tetrahydrofuran, methylene chloride, methyl ethyl ketone, cyclopentanone, cyclohexanone, toluene, chlorobenzene or mixtures thereof.

Suitable binders are all resins or polymer materials which are soluble in organic solvents and are capable of binding the dye to the inert carrier in an abrasion-resistant manner. Preferred binders are those which, after drying of the printing ink in the air, absorb the dye in the form of a clear, transparent film without visible crystallization of the dye occurring.

Such binders are stated, for example, in EP-A-441 282 or the patent applications cited there. Saturated linear polyesters are also suitable.

Particularly preferred binders are ethylcellulose, ethylhydroxyethylcellulose, polyvinyl butyrate, polyvinyl acetate, cellulose propionate and saturated linear polyesters.

The weight ratio of binder to dye is in general from 1:1 to 10:1.

Examples of suitable assistants are release media as stated in EP-A-441 282 or in the patent applications cited there. Further assistants are in particular organic additives which prevent crystallization of the transfer dyes during storage or during heating of the color ribbon, such as cholesterol or vanillin.

Suitable inert carriers are likewise described in EP-A-441 282 and in the patent applications cited there. The thickness of the dye carrier is in general from 3 to 5 30 μm, preferably from 5 to 10 μm.

Suitable dye acceptor layers are in principle all heat-stable plastic layers having affinity to the dyes to be transferred, for example modified polycarbonates or polyesters. Further details in this context are given in EP-A-441 282 or in the patent applications cited there.

Dye transfer is effected with the aid of an energy source, such as a laser or, in particular, a thermal printing head, where the latter must be capable of being heated to ≧300° C. so that the dye transfer can take place in the time range t of $0<t<15$ msec. The dye migrates from the transfer sheet and diffuses into the surface coating of the absorbing medium.

EXAMPLES

For the production of the color ribbons, 10 g of the dye I were stirred into 100 g of a 10% strength by weight solution of a binder (Vylon® 290 from Toyobo) in a 4.5:2:1 (v/v/v) methyl ethyl ketone/- toluene/cyclohexanone mixture, if necessary with brief heating at from 80° to 90° C.

The printing ink obtained was applied to a 6 μm thick polyester film having an antifriction backing layer by means of a 6 μm doctor blade. The color ribbons were first blown dry for 1 minute with a blower and then dried in the air for at least a further 24 hours in order to remove residual amounts of solvent.

The color ribbons were then used for printing on Hitachi VY-S video print paper on a computer-controlled experimental arrangement having a commercial thermal printing head.

The energy released by the thermal printing head is controlled by changing the voltage, the set pulse duration being 7 ms and only one pulse being released in every case. The energy released is thus from 0.71 to 1.06 mJ per dot.

Since the level of coloring is directly proportional to the energy supplied, a color wedge can be produced and can be evaluated spectroscopically. The Q* value (=energy in mJ for the extinction value 1) and the slope m in 1/mJ are determined from the plot of the depth of color against the energy supplied per dot.

The transferred anthraquinone dyes I, their absorption maximum $\lambda_{max}$ [nm]measured in methylene chloride, their half-width values HWV [$cm^{-1}$]and their transfer data Q* [mJ/dot] and m [1/mJ] are shown in the Table below.

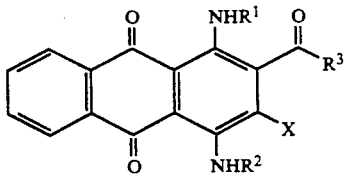

I where

X is hydrogen or cyano, $R^1$, $R^2$ and $R^3$ independently of one another are each hydrogen, alkyl, alkanoyloxyalkyl, alkoxycarbonyloxyalkyl or alkoxycarbonylalkyl, each of which may be of up to 20 carbon atoms and may be substituted by halogen, hydroxyl or cyano, phenyl or benzyl, each of which may be substituted by $C_1$–$C_{15}$-alkyl or $C_1$–$C_{15}$-alkoxy or a radical of the formula II $$[-W-O]_n-R^4 \qquad \text{II}$$

where the radicals W are identical or different $C_2$–$C_6$-alkylene radicals, n is from 1 to 6 and $R^4$ is $C_1$–$C_4$-alkyl or unsubstituted or $C_1$–$C_4$-alkyl-substituted or $C_1$–$C_4$-alkoxy-substituted phenyl.

TABLE

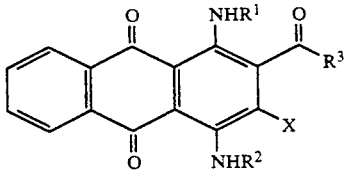

I

| Example | $R^1$ | $R^2$ | $R^3$ | X | $\lambda_{max}$ [nm] | HWV [$cm^{-1}$] | Q* [mJ] | m [1/mJ] |
|---|---|---|---|---|---|---|---|---|
| 1 | —H | n-$C_4H_9$ | —$CH_3$ | —H | 682 | — | 1.26 | 1.38 |
| 2 | —H | -Ph-3-$CH_3$ | —$CH_3$ | —H | 676 | 3654 | 1.60 | 1.00 |
| 3 | —H | -Ph-2-$CH_3$ | —$CH_3$ | —H | 677 | 3645 | 1.58 | 1.00 |
| 4 | —H | -Ph-4-$CH_3$ | —$CH_3$ | —H | 678 | 3661 | 1.62 | 1.00 |
| 5 | —H | —$(CH_2)_3$—O—$CH_3$ | —$CH_3$ | —H | 679 | 3650 | 1.19 | 1.57 |
| 6 | —H | —H | -Ph | —H | 600 | 3467 | 1.45 | 0.96 |
| 7 | -Ph | -Ph | —$CH_3$ | —H | 715 | 3562 | 1.55 | 0.91 |
| 8 | —H | -Ph-3-$CH_3$ | —$CH_3$ | —CN | 710 | 3458 | 1.62 | 1.00 |
| 9 | —H | —$(CH_2)_3$—O—$CH(CH_3)_2$ | —$CH_3$ | —H | 680 | 3510 | 1.53 | 1.01 |
| 10 | —H | -Ph(2-$CH_3$)-5-$CH_3$ | —$CH_3$ | —H | 678 | 3850 | 1.19 | 1.45 |

We claim:

1. A method for thermal transfer printing which comprises the steps of transferring an anthraquinone dye from a transfer to a plastic-coated substrate with the aid of a heat pulse, wherein said transfer comprises one or more dyes of the formula I

2. A process as claimed in claim 1, wherein said transferring is carried out with said dyes, where X is hydrogen or cyano and $R^1$, $R^2$ and $R^3$ independently of one another are each hydrogen, $C_1$–$C_{12}$-alkyl whose carbon chain may be interrupted by from 1 to 3 oxygen atoms as ether functions, or unsubstituted or $C_1$–$C_4$-alkyl-substituted or $C_1$–$C_4$-alkoxy-substituted phenyl.

3. A process as claimed in claim 1, wherein said transferring is carried out with said dyes, where X is hydrogen or cyano, $R^1$ is hydrogen, $R^2$ is unsubstituted or $C_1$–$C_4$-alkyl-substituted or $C_1$–$C_4$-alkoxy-substituted phenyl and $R^3$ is hydrogen, $C_1$–$C_4$-alkyl or unsubstituted or $C_1$–$C_4$-alkyl-substituted or $C_1$–$C_4$-alkoxy-substituted phenyl.

4. A process as claimed in claim 1, wherein said transferring is carried out with said dyes, where X and $R^1$ are each hydrogen, $R^2$ is unsubstituted or $C_1$–$C_4$-alkyl-substituted or $C_1$–$C_4$-alkoxy-substituted phenyl and $R^3$ is methyl.

* * * * *